United States Patent [19]

Phillips

[11] Patent Number: 4,461,855

[45] Date of Patent: Jul. 24, 1984

[54] RESIN COMPOSITE REINFORCED WITH FIBERS HAVING A FLAT-SIDED TRIANGULAR SHAPE

[75] Inventor: Leslie N. Phillips, Farnborough, England

[73] Assignee: The Secretary of State for Defence in Her Britannic Majesty's Government of the United Kingdom of Great Britain and Northern Ireland, London, England

[21] Appl. No.: 471,151

[22] Filed: Mar. 1, 1983

Related U.S. Application Data

[63] Continuation of Ser. No. 294,554, Aug. 20, 1981, abandoned.

[30] Foreign Application Priority Data

Aug. 28, 1980 [GB] United Kingdom ..... 8027842

[51] Int. Cl.[3] ..... B32B 9/00; C08K 3/04; D02G 3/00

[52] U.S. Cl. ..... 523/222; 428/364; 428/367; 428/372; 428/379; 428/397; 428/413; 524/495

[58] Field of Search ..... 428/364, 367, 397, 408, 428/614, 372, 411, 379, 375, 413; 524/907, 495, 496

[56] References Cited

U.S. PATENT DOCUMENTS

| | | | |
|---|---|---|---|
| 2,939,202 | 6/1960 | Holland | 428/224 |
| 3,109,768 | 11/1963 | Ellingsen | 428/397 |
| 3,194,002 | 7/1965 | Raynolds et al. | 428/401 X |
| 3,535,093 | 10/1970 | Sara | 428/367 X |
| 3,853,600 | 12/1974 | Hou | 428/401 X |
| 3,853,610 | 12/1974 | Byrne et al. | 428/401 X |
| 3,894,863 | 7/1975 | Lachman et al. | 428/367 X |

*Primary Examiner*—Lorraine T. Kendell
*Attorney, Agent, or Firm*—Cushman, Darby & Cushman

[57] ABSTRACT

High strength, high modulus reinforcement fibres having a greatest cross-sectional dimension of about 100 μm or less and suitable for setting in a matrix material, e.g. resin, are characterized by a cross-sectional shape which is or approximates to a flat-sided polygon of three or more sides, preferably three sides.

4 Claims, 6 Drawing Figures

RESIN COMPOSITE REINFORCED WITH FIBERS HAVING A FLAT-SIDED TRIANGULAR SHAPE

This is a continuation, of application Ser. No. 294,554, filed Aug. 20, 1981, now abandoned.

The present invention relates to reinforcement fibres for use as high strength high modulus composite structural materials.

BACKGROUND OF THE INVENTION

Reinforcement fibres of high tensile strength, eg greater than 0.5 GPa, eg about 2 GPa, and high Young's modulus, eg greater than 50 GPa eg about 200 GPa, are widely used in advanced structural materials for a variety of engineering applications. Such fibres which may be of carbon or glass, for example typically have a diameter less than 100 μm, eg typically 5 to 10 μm, to give the high modulus and tensile strength properties. They are set inside a matrix of ceramic, glass, metal or organic polymeric material to provide a structural material having overall improved mechanical properties, eg modulus and tensile strength.

Most high strength, high modulus reinforcement fibres have a roughly circular cross-sectional shape although a 'dog-bone' shape is also known.

These known shapes do not give ideal packing properties when such fibres are being set to form a high strength, high modulus composite material and are not in certain cases ideal for fibre manufacture. For example, carbon fibres are made by oxidation of precursor fibres involving diffusion processes and such processes are not ideal with the shape mentioned.

It is an object of the present invention to improve the packing density of high strength, high modulus reinforcement fibres and to reduce the manufacture time of the fibres where this involves diffusion processes, eg as in the case of carbon fibres.

DETAILED DESCRIPTION OF THE INVENTION

According to the present invention high strength, high modulus reinforcement fibres having a greatest cross-sectional dimension of about 100 μm or less and suitable for use to form reinforced composite materials by setting in a matrix material are characterised by a cross-sectional shape which is or approximates to a flat-sided polygon, of three sides or more, preferably a triangle.

Preferably the cross-sectional shape is an equilateral triangle. The corners of the triangle may be slightly rounded (in other words they do not have to come to a point).

The shape may alternatively be a square, pentagon or hexagon.

The fibres may be of any known material for reinforcement fibres, eg carbon, glass, silicon carbide, aluminium oxide, aromatic polyamide, quartz or Kevlar.

Structures having elongate reinforcement elements of various shapes other than circular are known but the art involved is a totally different art from that which the present invention is concerned with. That is, such elements are for use with macrostructures, eg for reinforced concrete. As a result the physical requirements of the structures are quite different from those of the high strength, high modulus reinforced composite materials which the present invention is concerned with, which are for use in such advanced applications as structures for use in the aerospace industry.

The advantages of reinforcement fibres according to the present invention (as compared with known reinforcement fibres) for the same uses are as follows.

Firstly, when the fibres are incorporated as a reinforcement in a matrix, eg one of the known matrices mentioned above, it is possible to achieve a greater density of fibres within the matrix.

Certain mechanical properties of the material are determined largely by the presence of the fibres and a greater packing density normally gives improved mechanical properties.

Secondly, when the fibres are incorporated as a reinforcement in a matrix it is possible to achieve better bond between the fibres and the matrix material. The bond is an important factor determining the likelihood of failure of the reinforced material. The fibres according to the present invention give a better bond because they present flat contact surfaces of greater area (than circular fibres of the same cross-sectional area) which in turn provide wider and more uniform lines of adhesion with less stress concentration.

Thirdly, the fibres may in certain cases be manufactured more cheaply. For example, in the case of carbon fibres which are made by oxidising and subsequently carbonising precursor fibres (eg based on polyacrylonitrile) the oxidation and carbonisation steps may be carried out in shorter times since they depend on diffusion processes across the fibre: these diffusion processes occur more quickly because the shortest distance from the outside of the fibre to the centre of the fibre is reduced as explained below using fibres according to the present invention.

A reinforcement fibre is generally made by a process involving the extrusion, ejection or drawing of material (eg whilst spinning) through an orifice, eg of a nozzle or spinneret. This material may be the precursor of the final reinforcement fibre material (eg polyacrylonitrile in the case of carbon fibres) or it may be the reinforcement fibre material itself (eg as in the case of glass fibres). In the case of fibres according to the present invention the cross-sectional shape of the (or each) orifice is normally a flat-sided polygon matching the shape of the required fibres, eg triangular for triangular fibres. In certain cases however the shape may be multilobar, eg trilobar for triangular fibres, to allow for any distortion which may occur after the fibre (or precursor strands) emerges from the orifice to reduce drag during the extrusion, ejection or drawing process. This may be desirable where the fibre (or precursor strand) is a polymer. In practice, the shape of the orifice, if not flat-sided, is unlikely to depart significantly from a flat-sided polygon. Apart from the use of a polygonal or polylobar shaped orifice the manufacture of fibres according to the present invention is carried out using steps which are known for the (particular) fibre or its precursor.

The fibres according to the present invention may be used in any way known to those skilled in the art to provide fibre reinforced materials or materials which may be converted into them.

In the case of fibres, eg of carbon or glass, which are of a type conventionally employed in an organic polymeric matrix, such fibres may be treated with an uncured or partly cured hot-setting resin to form a 'prepreg' or a tape of unwoven fibres which may subsequently be set by heat treatment into a structural material either alone or laminated with other material, eg metal. Alternatively such fibres may be woven into a cloth which may subsequently be used to reinforce a thermoplastics material or a hot or cold setting resin to form a reinforced structure which may exist either alone or laminated with other material.

BRIEF DESCRIPTION OF THE DRAWINGS

Embodiments of the present invention will now be described by way of example with reference to the accompanying drawings, in which.

DETAILED DESCRIPTION OF THE DRAWINGS

Figure 1:
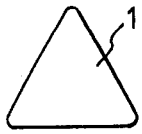
FIG. 1 shows, in cross-section, a carbon fibre embodying the invention.
Figure 2:
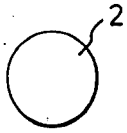
PRIOR ART Fig. 2.
FIG. 2 shows, in cross-section, a known carbon fibre.

In FIG. 1 a carbon fibre 1 embodying the invention is shown. The fibre 1 has an equilateral triangular cross-sectional shape with rounded corners 3. The fibre 1 may be contrasted with a conventional carbon fibre 2 having the same cross-sectional area and of circular cross-sectional shape as shown in FIG. 2.

Figure 1A:
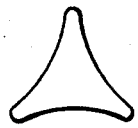
FIG. 1*a* shows an ejection nozzle for producing fibres.

Carbon fibres identical to the fibre 1 (referred to hereinafter as 'triangular fibres 1' may be made as follows:

Polyacrylonitrile, PAN, with which may be blended another precursor copolymer and with conventional additives such as stabilisers as necessary, is spun in a conventional way in a solvent such as dimethylformamide, through a spinneret into a coagulating bath, eg at 40° C., to form strands for subsequent conversion into fibres. The shape of the orifices of the spinneret are normally the same as that of the required fibres as shown in FIG. 1, but they may be trilobar as shown in FIG. 1*a* if there is an outward distortion of the strand shape after emerging from the spinneret, depending on the size of the strand, the speed of ejection and the composition of the polymer. The choice of precursor shape will be clear to those skilled in the art given the above parameters involved. The strands are coagulated, stretched into fibres and dried using known procedures.

PAN fibres produced by the above process are then oxidized under tension in a known way, eg by stretching, by winding on a graphite frame, and heating in an open furnace at about 220° C. for a sufficient time, which depends on the cross-sectional area of the fibre, but is typically 1 to 4 hours, to convert the polymer into a form suitable for carbonisation.

Carbonisation then takes place by heating the fibres, preferably under tension, at an elevated temperature eg in the range 1100° C. to 2500° C., depending on the kind of carbon fibre required, for many hours, eg up to 24 hours or more. This produces fibres of carbon having the same highly oriented mechanical properties as the original PAN fibres.

The minimum duration of the oxidation stage is the time required for oxygen to permeate to the centre of the fibres. This time t is roughly proportional to the square of the shortest distance x between the outside and centre of the fibre. Thus for the known circular fibres 2, $t \simeq kr^2$ where k is a constant and r is the radius of the circle of the cross-sectional shape. However for the triangular fibres 1, $t \simeq kd^2$ where d is the distance from the centre to the base of the triangular. For a perfect equilateral triangle having a centre to base distance d and an area equal to that of a circle of radius r the ratio $r^2/d^2 = 1.65$. This means that the oxygen permeation process takes roughly 1.6 times longer with the known circular fibre 2 than with the triangular fibres 1 of the same cross-sectional area (and hence of the same weight per unit length).

During the carbonisation stage volatile gases such as cyanogen are evolved and these are expelled from the fibre by diffusion processes. The duration of these processes is largely a function of the distance x from the centre to the outside of the fibre (as in the case of oxygen permeation). For reasons similar to those given above in relation to oxygen permeation time shorter carbonisation times may be achieved using the triangular fibres 1 instead of the known circular fibres 2.

Figure 3:
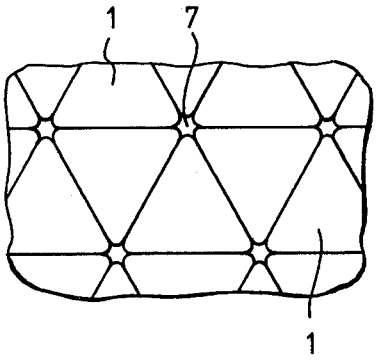
FIG. 3 shows, in cross-section, part of a fibre reinforced structure containing carbon fibres as shown in FIG. 1.
Figure 4:
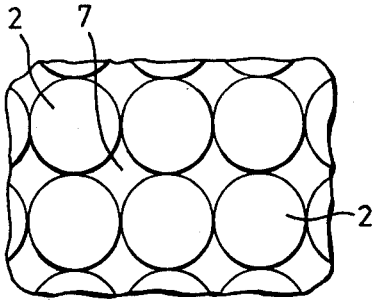
PRIOR ART Fig. 4.
FIG. 4 shows, in cross-section part of a fibre reinforced structure containing known carbon fibres as shown in FIG. 2.

FIG. 3 shows some of the triangular fibres 1 embedded in a plastics or resin matrix 7 by one of the known methods mentioned above and FIG. 4 shows the known circular fibres 2 embedded in the same matrix 7. As will be seen by comparing FIGS. 3 and 4 the fibres 1 may be packed more closely together than the fibres 2 (in certain parts of the matrix 7 at least) giving an improvement in certain mechanical properties, eg in tensile strength, modulus and stiffness, of the resultant reinforced material. The resin may be known epoxy resin for example.

The adhesion of the fibres to the material of the matrix 7 is determined (amongst other things) by the surface area of the fibres. A perfect equilateral triangle has a perimeter 1.27 times the circumference of a circle of equal area. Thus, the triangular fibres 1 have a surface area per unit length roughly 1.2 times that of the circular fibres 2 giving an improvement in adhesion to the material of the matrix 7.

Any known article made from fibre reinforced material, eg a lightweight internal structure for an aircraft or a sports implement such as a golf club, or fishing rod, may be made from reinforced material containing triangular fibres embodying the present invention.

Figure 3A:
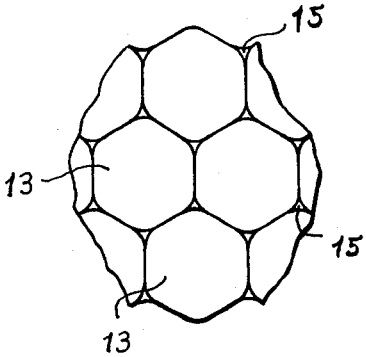
FIG. 3*a* shows an alternative structure.

Fibres of other polygonal shape embodying the invention may be made and used in a similar way. For example fibres having a regular hexagonal shape may be using a hexagonal orifice in the nozzle or spinneret from which the fibre or its precursor is drawn or ejected. Such fibres pack with each of the six sides of each fibre adhering to corresponding sides of adjacent fibres in a honeycomb fashion as shown in FIG. 3*a* (the fibres being indicated by reference numeral 13 and the matrix material by reference numeral 15).

Triangular carbon fibres have been successfully produced from precursor fibres which were 44.5 μm sided triangles. The precursor material was Courtaulds' PAF (Trade Mark) which is a polyacrylonitrile material of the Courtelle (Trade Mark) family. The precursor fibres could be extruded through a hole shape as shown in FIG. 1*a* at several speeds (typically 1.5 meters/second).

Despite the fact that many materials, particularly thermoplastics, tend to revert to their original shape on heating it was found that the oxidation of these precursor fibres proceeds smoothly from the outside inward and that there is negligible distortion of shape on oxidation. In other words, the triangular shape remained during oxidation.

The resulting triangular cross fibres tended to aggregate together to form hexagonal clusters, which facilitates packing when they are contained in the matrix.

Composites, particular carbon fibres composites, with fibre content of up to 70% are possible instead of the usual ~55% maximum and roughly proportionate improvements may be obtained in the flexural strength of the resulting composite.

I claim:

1. A composite material comprising reinforcement fibers and a resin matrix material, said composite comprising up to 70% fibers, said fibers having a tensile strength greater than 0.5 GPa and a Young's Modulus greater than 50 GPa, and having a greatest cross-sectional dimension of about 100 μm or less, said fibers having a cross-sectional shape which is triangular, each side of said fibers being flat, the sides of least some of the fibers contacting and adhering to the sides of adjacent fibers, so that at least some of the fibers are aggregated in clusters, at least some of the fibers being aggregated in hexagonal clusters.

2. A composite as claimed in claim 1 in which said composite comprises between 55% and 70% fibers.

3. A composite as claimed in claim 1 in which said fibers have a cross-sectional shape which is an equalateral triangle, the corners of said triangle being rounded.

4. A composite as claimed in claim 1 in which said fibers are carbon, their precursor being polyacrylonitrile or a copolymer thereof which precursor is made by a process involving drawing or ejecting the precursor through a triangular or trilobar nozzle or spinneret.

* * * * *